United States Patent [19]

Pfister

[11] 4,415,109

[45] Nov. 15, 1983

[54] APPARATUS FOR THE TRANSPORT OF A LIGHT SENSITIVE MATERIAL IN A PHOTOTYPESETTING MACHINE

[75] Inventor: Joseph Pfister, Niederteufen, Del.X

[73] Assignee: H. Berthold, AG, Berlin, Fed. Rep. of Germany

[21] Appl. No.: 283,958

[22] Filed: Jul. 16, 1981

[30] Foreign Application Priority Data

Jul. 23, 1980 [DE] Fed. Rep. of Germany ..... 3028238

[51] Int. Cl.[3] ..... B65H 77/00; B65H 17/22

[52] U.S. Cl. ..... 226/181; 226/120; 242/75.44

[58] Field of Search ..... 242/75, 75.43, 75.44; 226/24, 25, 120, 44, 181, 153, 155, 45

[56] References Cited

U.S. PATENT DOCUMENTS

| | | | |
|---|---|---|---|
| 437,021 | 9/1890 | Cunningham | 226/180 |
| 2,737,387 | 3/1956 | Harris et al. | 226/45 X |
| 2,825,016 | 2/1954 | Bailey | 242/75 X |
| 3,044,423 | 7/1962 | Pottle | 226/153 X |
| 4,007,865 | 2/1977 | Crandall | 226/180 X |

FOREIGN PATENT DOCUMENTS

| | | | |
|---|---|---|---|
| 284506 | 1/1914 | Fed. Rep. of Germany | 226/180 X |
| 2816320 | 10/1978 | Fed. Rep. of Germany . | |

*Primary Examiner*—John M. Jillions
*Assistant Examiner*—Dao Van Huynh
*Attorney, Agent, or Firm*—Andrus, Sceales, Starke & Sawall

[57] ABSTRACT

Apparatus for the insertion, guiding, and transportation of recording material of different widths out of a storage cassette in a phototypesetting machine. In a transport roller pair, the drive roller forms a stationary air slot with the opposing roller greater than the thickest material for facilitating the insertion of the material. The roller pair is arranged at an angular position deviating from the transport direction of the material so that the material is guided with one side against a guide stop.

4 Claims, 2 Drawing Figures

Figure 1:
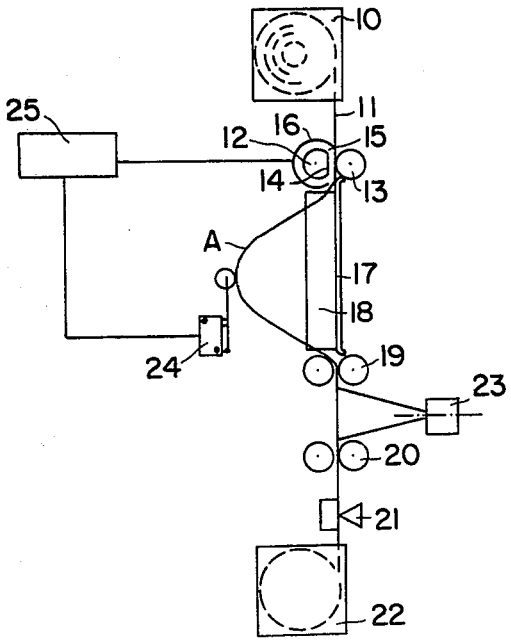

APPARATUS FOR THE TRANSPORT OF A LIGHT SENSITIVE MATERIAL IN A PHOTOTYPESETTING MACHINE

The invention relates to an apparatus for the insertion, guiding, and transportation of light sensitive material of different widths out of a storage cassette to a take up cassette of a phototypesetting machine, whereby the light sensitive material is transported with a side edge against a guide stop.

Phototypesetting machines or photocomposition systems work, to an increasing extent, separate from an input or control station, mainly as so called exposure units. The texts or lines to be exposed are supplied by means of a data carrier along with the composition parameters, such as composition format, column width and, type size. Thus, the exposure unit is in the position to automatically expose, to transport, and to store the film for many pages in a take up cassette. It thus occurs that the operator periodically must insert new unexposed material in the storage cassette of the exposure unit. Thus, it is, in known techniques, dependent on the dexterity of the operator as he threads the leader of the light sensitive material that this material can be taken up by a transport mechanism. Often, either a first transport roller pair must be separated from each other through a mechanical lever or the material must be conveyed to an already running transport apparatus.

These named possibilities additionally lead frequently to the situation in which the material is not drawn in straight and stress free and bucklings and deformations form. In this case a reverse transportation and a new conveying of the material is necessary.

An advancement in phototypesetting machines consists in that different widths of light sensitive material can be exposed, for example, for the purpose of more economical utilization of film in connection with smaller composing work. Thus in phototypesetting machines, it is known to guide the material between two guide rims running in the transport direction, preferably without play, whereby one of the guide rims is axially shiftably adjustable for different width materials. It is also known to provide the material with holes running on both sides of the guide rims, and to transport the material with corresponding transport sprockets, whereby also here the transport sprockets must be shiftable with different material widths. Through DE-AS No. 28 16 320, an apparatus is known for the multiple column phototype setting, by which the band formed light sensitive record carrier is conveyed out of an unwinding apparatus between space forming guide plates and a fixed side guide through to a transport roller pair and from there is brought into a windup apparatus running in synchronization with the transport rollers. Thus the recording carrier can be transported through definitive limits in its longitudinal direction back and forth.

The transport and the guiding of the record carrier in the longitudinal direction occurs only along one side of the recording carrier. By two swinging rollers, which in each case can lie slanting in the movement direction, a constant pressure on the lateral guide stop should be attained. The slanting position of the swinging rollers or the pressure rollers is dependent on the transportation speed and on the pressure, adjustable by hand, on the opposing roller as well as on the condition and thickness of the recording carrier. The slanting position of the swinging rollers and their inclination, further automatically effects, in an record carrier straightening manner, a tension in opposition to the previous transport apparatus. Also it is seen as disadvantageous that in this arrangement of a transport apparatus, the unwinding apparatus or storage cassette must be placed on a laterally displaceable sliding carriage. In general there results from this a complicated and expensive transport device.

It is the object of the present invention, to be able to insert different widths of light sensitive material very simply in the transport apparatus of a photocomposition machine and simultaneously to make possible and automatic placing of a side edge of the material on a guide stop, independently of the transport of the material to the exposure position of the phototypesetting machine.

This object is achieved according to the invention in that for the simple insertion of the light sensitive material, the drive roller of a first transport roller pair, over its entire transport width, is provided with a milled off surface for the formation of an entry space and this transport roller pair takes on a slanting position toward the one-sided guide stop.

The light sensitive material can now with the initial insertion, for example, out of a new storage cassette very easily and simply be brought between a first transport roller pair, as the said milled off surface of the drive roller, in its base or reference position, always forms an entry space with the opposing roller. The space is so dimensioned that the most different material, such as paper or film of different strengths, can be fully freely fed through this space.

The oblique positioning of this first roller pair results in the light sensitive material being transported with a side edge biased against a guide stop with light pressure. Such slanting positioning of the transport rollers is, to be sure, already known and leads as a rule to a uncontrollable buckling and deformation or to longitudinal changes of the transport material. These disadvantages are now overcome in an advantageous manner, that in advantageous ways the slot occurring after each revolution of the roller pair permits a self-actuated slackening of the light sensitive materials.

Thus, four essential criteria for the exact transport of light sensitive material in a phototypesetting machine are accomplished, namely the very simple insertion, the exact guiding of a side edge of the material, that the material can be stress free, and that the material is drawn out of the storage cassette to the exposure position independently of other transport.

The invention is further explained below with the aid of exemplary embodiments. In the figures FIG. 1 shows a schematic side view of a transport device.

Figure 2:
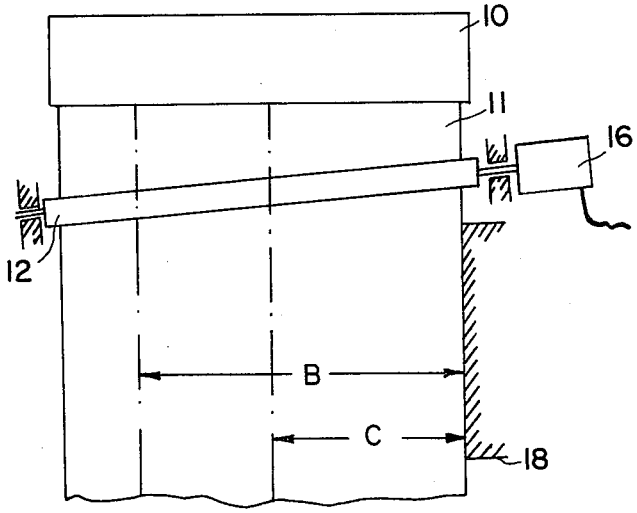

FIG. 2 shows a plan view of the storage cassette and a first transport roller pair.

The transport device for the material to be exposed in a phototypesetting machine is schematically shown in FIG. 1.

A storage cassette 10 contains the light sensitive material 11 either as paper or film material. This storage cassette can be a component of a phototypesetting machine; that is, it is loaded with a roll material or, rather, the entire cassette including the material already packaged is obtainable through suitable suppliers.

A first transport roller pair 12, 13, is so formed that the drive roller 12 presents a milled off surface along the entire transport width for the maximum width of the film material so that a guide slot 15 is formed with the opposing roller 13.

The operator merely guides the material in this slot and leaves the further threading and transport operation to the photocomposing machine.

The roller 12, driven by means of motor 16, now draws the material 11 initially out of the storage cassette 10 in a guide 17 and along a guide stop 18 to a second transport roller pair 19.

A third roller pair 20, a cutting device 21 and a take up cassette 22 are further components of this transport apparatus.

An optical image reproduction system 23 is schematically indicated, by which a matrix strip transverse to the transport direction of the material can be illuminated on the material, whereby the spacing of the roller pairs 19, 20 is greater than the greatest possible adjustable type size. The roller pair 19 and 20 can be driven synchronism with the first roller pair 12, 13, but however become stationary as soon as the material passes beyond the third roller pair 20 to a not further disclosed responder device.

The first roller pair 12, 13, transports material out of the storage cassette 10 to a supply loop A only until the switch 24 is actuated through the so formed loop and signals a control device. This control device then switches off the motor 16 of the drive roller 12 in the subsequent reference or base position, and thus with "slit formation". In addition to the disclosed storage loop, the second and third roller pair 19, 20 can undertake a reverse transport of the material 11 for the purpose of forming a further text column next to that already set or for line ruling so that the entire preselected format length (pages length) is additionally transported back to in the storage space.

FIG. 2 shows, in plan view, the storage cassette 10, the light sensitive material 11, and the drive roller 12 with motor 16. The pair of dotted lines indicates varying material widths B or C.

Through the slanting position of the drive roller 12, the material 11 is transported against the guide stop 18, whereby the illustrated slanting position has been intentionally shown in exaggerated slant for the purpose of better explanation.

The operation of roller pair 12, 13 serves only for the initial insertion and bringing in position of a new light sensitive material. During the actual type setting process of the machine, the second and third rollers pairs 19 and 20 transport the material 11 independently from the first roller pair 12, 13, in the direction of the take up cassette 22 or also in reverse in order to enable setting of a plurality of text columns side by side in a page formate or for the production of lines, for instance for a form.

I claim:

1. Apparatus for inserting, guiding, and transporting recording material of different widths along a straight path extending from a storage cassette into a phototypesetting machine comprising:

a guide stop (18) positioned along one side of the path;

a pair of opposing, rotatable transport rollers (12, 13) lying across the path adjacent said guide stop at an angle to the path, said rollers receiving the material therebetween for moving the material along the path when rotated while providing a bias force urging the material against said guide stop, said roller pair being so formed as to disengage the material at at least one rotary position of the rollers to permit threading of the material between the rollers and to release the bias force to avoid buckling the material against said guide stop; and drive means for rotating at least one of said rollers.

2. Apparatus according to claim 1 wherein one of said rollers (12) has a milled-off surface (14) along its entire length for providing a spacing between the one roller and the opposing roller and disengagement of the material.

3. Apparatus according to claim 2 wherein said drive means is connected to said roller having said milled-off surface.

4. Apparatus according to claim 1 wherein a storage loop (A) is formed in the typesetting machine downstream of said pair of transport rollers and wherein said apparatus includes sensing means for sensing the magnitude of the storage loop, said sensing means being coupled to said roller drive means for stopping said rollers in the material disengaging position upon sensing a storage loop of predetermined magnitude.

* * * * *